US010065123B2

(12) United States Patent
Zamperla

(10) Patent No.: US 10,065,123 B2
(45) Date of Patent: Sep. 4, 2018

(54) AMUSEMENT RIDE COMPRISING A STATION WITH A MOVABLE FLOOR ELEMENT

(71) Applicant: ANTONIO ZAMPERLA S.P.A., Altavilla Vincentina (IT)

(72) Inventor: Alberto Zamperla, Altavilla Vicentina (IT)

(73) Assignee: ANTONIO ZAMPERLA S.P.A., Altavilla Vicentina (IT)

( * ) Notice: Subject to any disclaimer, the term of this patent is extended or adjusted under 35 U.S.C. 154(b) by 0 days.

(21) Appl. No.: 15/559,467

(22) PCT Filed: Mar. 24, 2016

(86) PCT No.: PCT/EP2016/056650
§ 371 (c)(1),
(2) Date: Sep. 19, 2017

(87) PCT Pub. No.: WO2016/151113
PCT Pub. Date: Sep. 29, 2016

(65) Prior Publication Data

US 2018/0085676 A1 Mar. 29, 2018

(30) Foreign Application Priority Data

Mar. 24, 2015 (EP) ..... 15160637

(51) Int. Cl.
*A63G 1/34* (2006.01)
*A63G 7/00* (2006.01)
*A63G 31/00* (2006.01)

(52) U.S. Cl.
CPC ..... *A63G 7/00* (2013.01)

(58) Field of Classification Search
CPC ..... A63J 1/00; A63J 5/00; A63J 5/12; A63G 1/00; A63G 31/00; A63G 31/16; A63G 1/34; A63G 1/48; A63G 7/00
(Continued)

(56) References Cited

U.S. PATENT DOCUMENTS 7,905,790 B2 * 3/2011 Schnuckle ..... A63J 1/02 472/43
8,313,389 B2 * 11/2012 Crawford ..... A63G 1/06 446/325

(Continued)

FOREIGN PATENT DOCUMENTS

DE 19808185 9/1998
DE 102009044965 3/2011

(Continued)

OTHER PUBLICATIONS

International Search Report and written opinion dated Jun. 1, 2016 for PCT application No. PCT/EP2016/056650.

(Continued)

*Primary Examiner* — Kien Nguyen

(57) ABSTRACT

An amusement ride (1) and a method for its operation are disclosed. The amusement ride comprises a track (10) along which at least one vehicle (50) is movable, and at least one station (2) for the embarkation and/or disembarkation of passengers. The station comprises at least one platform (3) arranged above a portion of said track (10) in correspondence of the station (2), and the platform comprises an opening (S) for the transit of the vehicle (50) in the station. At least one floor element (20*a*, 20*b*, 20*c*) is arranged in at least one first position in which said floor element closes the opening (S) and is movable from the at least one first position to at least one second position to allow the transit of said vehicle (50) in the station (2). Returning means (25) are configured to move the at least one floor element (20*a*, (Continued)

20*b*, 20*c*) from the at least one second position back to the at least one first position in which said floor element closes the opening (S).

17 Claims, 5 Drawing Sheets

(58) Field of Classification Search
USPC ..... 472/43, 59, 60, 88, 91
See application file for complete search history.

(56) References Cited

U.S. PATENT DOCUMENTS 9,017,178 B2 * 4/2015 Jackson ..... A63J 5/12
472/43
2007/0199474 A1 8/2007 Zamperla
2010/0326313 A1 12/2010 Baker et al.

FOREIGN PATENT DOCUMENTS

EP 1020213 7/2009
WO 03082421 10/2003

OTHER PUBLICATIONS

European Search Report and written opinion of priority application No. 15160637.3 dated Jan. 4, 2016.
Partial European Search Report and written opinion of priority application No. 15160637.3 dated Sep. 30, 2015.
International Search Report on Patentability issued for PCT application No. PCT/EP2016/056650 dated Sep. 26, 2017.

* cited by examiner

AMUSEMENT RIDE COMPRISING A STATION WITH A MOVABLE FLOOR ELEMENT

RELATED APPLICATIONS

This application is the US national phase application of international application PCT/EP2016/056650, filed 24 Mar. 2016, which designates the US and claims priority to European application EP 15160637.3 filed 24 Mar. 2015, the contents of each of which are hereby incorporated by reference as if set forth in their entireties.

FIELD OF THE INVENTION

The present invention relates to amusement rides, and in particular to roller coaster rides. The invention also relates to a method of operating the amusement ride and also to a station and a vehicle for the amusement ride.

BACKGROUND OF THE INVENTION

There are known in the art amusement rides, and in particular roller coaster rides, wherein one or more vehicles for accommodating the passenger(s) are moved along a track.

As known, in this type of amusement rides, drive means are able to move the vehicle in correspondence of the highest point of the track and then gravity accelerates downhill the vehicle along the remaining part of the track.

Different drive means are currently used to move the vehicle in correspondence of the highest point of the track, and in general to impart to the vehicle the required initial acceleration.

The amusement rides further comprises a station where the passenger(s) can be embarked on, and/or disembarked from, the vehicle(s).

An aim of amusement rides producers is to increase the fun and excitement of the passengers, and therefore the amusement rides are designed to increase velocity and accelerations to be reached.

Additionally, different sensations and experiences can be also provided by reducing the dimension of the vehicle, so as to reduce the components of the vehicle which obstruct the view of the passengers accommodated therein.

In other words, an aim in the amusement ride design is to reduce the number of components of the vehicle while allowing the required security needed for restraining the passengers in the vehicle and to support them during embarkation/disembarkation.

The vehicle of the amusement ride, and in particular of the roller coaster rides, are usually provided with seats for accommodating the passengers. The seats are arranged on a floor (vehicle platform) which is also used to support the passengers when they embark/disembark on/from the vehicle. However, the vehicle floor negatively affects the view of the passengers during the ride along the track.

An amusement ride having a vehicle with a reduced floor has been proposed, as for example disclosed in document EP1020213.

This document discloses an amusement ride wherein the station is provided with a fold-away, i.e. a retractable, floor intended to replace the absent floor of the vehicle and to support the passenger(s) when the vehicle is stopped at the station for embarkation/disembarkation.

However, the movement of the retractable floor, which has to be folded below the surface of the station, is complex to produce and could be subjected to undesired failure, due to the presence of different components.

In fact, a plurality of arms and actuators are needed to form the kinematic linkage intended to move the retractable (foldable) floor.

Additionally, the movement of the retractable floor needs to be accurately controlled and synchronized with the movement of the vehicle in the station, and also with both stop position and stop time, in order to effectively support the passengers.

Therefore, the complexity of the components and also of the control system of the amusement ride, for example by the need of using sensors, is increased. Additionally, when the vehicle is not stopped at the station the fold-away floors are retracted thus maintaining the platform opened.

In view of above, it is an object of the present invention to provide an amusement ride in which the embarkation/disembarkation of passenger(s) at the station can be carried out even if the at least one vehicle has reduced dimensions, and in particular it is provided with a reduced floor.

Another object of the present invention is to provide an amusement ride in which the floor elements of the station intended to replace the reduced floor of the vehicle are movable in a simple and reliable way, while providing the required support for the passenger(s) during the embarkation/disembarkation.

SUMMARY OF THE INVENTION

These and other objects are achieved by the amusement ride and the method of operating the amusement according to a first embodiment of the invention, described in independent claims 1 and 14. As discussed here below, the present invention also relates to two further embodiments of an amusement ride and of a method of operating the amusement ride.

Further aspects of the present invention are set out in the dependent claims. The present invention also relates to a station and also to a vehicle for an amusement ride.

The amusement ride according to a first possible embodiment of the invention comprises a track along which at least one vehicle is movable, and at least one station for the embarkation and/or disembarkation of passengers.

The station comprises at least one platform, arranged above a portion of the track in correspondence of the station, and an opening for the transit of the vehicle in the station. According to an aspect of the invention, the vehicle is moved on the track, with a portion of the vehicle arranged below the platform and another portion of the vehicle, preferably comprising at least one seat for the passenger, arranged above the platform.

At least one floor element is arranged in at least one first position in which the floor element closes the opening. The floor element is movable from said first position to at least one second position for allowing the transit of the vehicle in the station, and viceversa (i.e. from the at least one second position to the at least one first position). In other words, according to an aspect the at least one floor element is movable between the at least one first position and at least one second position.

According to an aspect, returning means are provided to move the at least one floor element from the second position back to the first position in which the floor element closes the opening. It has to be noted that the returning means are thus intended to maintain the at least one floor element in the at least one first position.

Advantageously, the presence of one or more floor element, and preferably a plurality of floor elements, arranged in a first position in which the floor element closes the opening providing a platform, wherein the opening for the transit of the vehicle is occupied by the floor element, provides the required support for the passengers.

Advantageously, the one or more floor element(s) is movable from the first position to the at least one second position for allowing the transit of the vehicle in the station. The one or more floor element(s) is preferably temporarily moved in said at least one second position. Therefore, the opening is normally closed, and temporarily opened when the vehicle is passing in said station.

Therefore, passengers or operators can be advantageously supported at all times, even when the vehicle is not at the station.

The returning means advantageously move the at least one floor element from the at least one second position back to the at least one first position in which said floor element closes the opening.

Advantageously, the returning means automatically return (move back) the floor element to the first position in which the opening is closed. The returning means exert a force maintaining the floor element in the first position. Therefore, the floor element is automatically repositioned (i.e. without the need of an active command or control) from the second position in the first position by the returning means.

In other words, the floor element is biased in the first position by the returning means.

According to a possible aspect the at least one floor element is a passive element, and in particular the control of the movement of the floor element via the returning means is of the passive type.

It has to be noted that the term "passive" is used herein to indicate that there is no need of an active control/command on the floor element and on the returning means, to cause the return of the floor element from the second position back to the first position.

It has to be noted that the returning means allow passive control of the at least one floor element, preferably the returning means comprises a spring or a similar elastic element intended to bias (maintain) the floor element in the first position, therefore the return in the first position does not need an active command to be carried out.

In general, according to a preferred aspect, the floor element can be moved without the need of actuators or similar moving means. Also the use of sensors intended to detect the position of the vehicle at the station can be avoided.

In fact, according to an advantageous aspect of the invention, the movement of the floor element can be controlled in a simple way by means of the vehicle moving inside the station, so that the use of actuators and sensors, or similar means intended to provide an active control of the floor element can be avoided.

Preferably, the movement of the floor portion is controlled by the contact of the vehicle with the floor element and the at least one floor element in the at least one first position is arranged to be contacted by the vehicle, so that the floor element can be moved towards the at least one second position.

The vehicle contacting the floor element overcome the biasing force exerted by the returning means, intended to maintain the floor element in the first position, thus causing the movement of the floor element in the second position.

When the vehicle no longer contacts the floor element, the returning means (e.g. a spring or similar elastic element) tends to automatically return the floor element in the first position, without the need of an active control or command. Preferably, the floor element is contacted by an intermediate portion of the vehicle provided between a frame of the vehicle and one or more seat of the vehicle.

An advantage of this aspect is to eliminate the necessity of controlling the actuation of the floor elements, for example by means of actuators, and also to eliminate the necessity of synchronizing the movement imparted by said actuators with the position of the vehicle in the station.

According to a preferred aspect, the at least one floor element is moved from the at least one second position back to the first position when the floor element is no longer contacted by the vehicle. An advantage of this aspect is to provide the required support for the passengers when the floor element is not contacted by the vehicle, because the floor element returns. In fact, as mentioned above, the returning means bias the floor element in the first position.

It has to be noted that the expression "the floor element closes the opening" is used herein to indicate that the floor element is arranged to provide support for the passengers. In other words, in the first (close) position, the at least one floor element is extending in correspondence of said opening to prevent passengers from falling inside the opening.

According to a preferred aspect, when the one or more floor element is the first position, the area of the opening that is free from floor element (i.e. the area not occupied by the floor element) does not allow the passage of a passenger, or of a portion of the passenger's body, therethrough.

According to an aspect, in the first position, the floor element extends between two sides of the opening (e.g. two cantilevered fixed sides), preferably between two substantially opposite sides of the opening.

In the at least one second position of the at least one floor element, an area of the opening is not occupied by the floor element thus allowing the transit of the vehicle.

In general, in the second position the at least one floor element covers a reduced area of the opening with respect to the area occupied by the floor element in the first position, in which it closes the opening.

According to an aspect, in the at least one second position the at least one floor element is completely removed from the opening, i.e. the floor element is not extending inside said opening.

According to still another aspect, the area of the opening not occupied by the at least one floor element is occupied by the vehicle, preferably by a portion (e.g. an intermediate portion of the vehicle) passing inside said opening.

By doing so, also when the at least one floor element is moved in the second position, the opening is substantially occupied by the vehicle and/or by another floor element in the first position.

According to still another aspect of the invention, the at least one floor element is movable, preferably rotatable, in a plane, between said at least one first position and said at least one second position. Preferably, the plane is substantially parallel to the platform.

Advantageously, the movement of the floor element in a plane, and in particular a rotation of the floor element in a plane that is substantially perpendicular with respect to the platform, reduces the space needed for the movement of the floor elements.

Therefore, the movement of the floor element, and in particular the rotary movement of the floor element, is simple and effectively closes the opening of the platform, for supporting the passenger(s), by providing a reduced number of components, with respect to the known foldable floor of the prior art.

According to an aspect of the present invention, the at least one floor element is rotatable about a rotation axis, between said at least one first position and said at least one second position, and the rotation axis is substantially perpendicular with respect to the platform.

Advantageously, the presence of at least one floor portion rotatable between a first position and a second position is a simple and effective way to provide a floor in correspondence of the opening of the platform.

The present invention also relates to a method of operating an amusement ride.

The at least one vehicle is moved along a track and also in a station provided with a platform for the embarkation/disembarkation of the passenger.

According to an aspect, the method comprises the step of moving at least one floor element from at least one first position, in which said floor element closes an opening of the platform, to at least one second position to allow the transit of said vehicle in the station. The method further comprises the step of moving the at least one floor element from said at least one second position back to said at least one first position by returning means.

Advantageously, the at least one floor element is arranged in the first position and temporarily moved, in at least one second position for allowing the passage (transit) of the vehicle.

Returning means allow to automatically move back the floor element from the second position to the first position, so as to close the opening, thus providing the required support for the passengers.

According to an aspect, the at least one floor element is movable, and preferably it is rotatable, in a plane between said at least one first position and said at least one second position. The plane in which the floor element is moved (preferably rotated) is substantially parallel to the platform.

The method further comprises the step of rotating, about a rotation axis substantially perpendicular to a platform of the station, at least one floor element.

Advantageously, the rotation of the floor element provides a simple way to move the floor element, thus providing the required support for the passengers during the embarkation/disembarkation, and allows movement of the vehicle in the station in its second position.

Advantageously, according to an aspect, the at least one floor element is a passive element. In fact, preferably no actuators are provided to actively control the movement and thus the position of the floor element. In fact, as mentioned above, the returning means (e.g. a spring or similar elastic means) exert a biasing force able to maintain the floor element in the first position.

In fact, according to an aspect, the at least one floor element is contacted by said at least one vehicle to move the floor element from the at least one first position to the at least one second position. The vehicle contacting the floor element, overcome the biasing force exerted by the returning means so as to temporally move the floor element in the second position.

According to an aspect, the at least one floor element is maintained in the at least one first position in which the floor element closes the opening, preferably by returning means exerting a biasing force towards the first position, and the floor element is moved from the at least one second position back to the at least one first position when the vehicle does not contact the floor element.

In fact, when the vehicle does not contact the floor the returning means (e.g. a spring or similar elastic element) tends to automatically returns the floor element in the first position without the need of an active control or command. Therefore, the floor element is automatically returned in the first position when the vehicle does not contact the floor element.

The present invention also relates to a station comprising at least one platform arranged above a portion of a track in correspondence of the station, and an opening for the transit of at least one vehicle in said station. The station further comprises at least one floor element arranged in at least one first position in which the floor element closes the opening and movable from the at least one first position to at least one second position to allow the transit of the vehicle in the station, and viceversa. Returning means are provided to move the at least one floor element from the at least one second position back to the at least one first position in which said floor element closes the opening.

Further aspects and features of the station according to the invention are disclosed herein.

The station can be used in an amusement ride comprising a track and at least one vehicle movable along said track, for example in an amusement ride according to the invention, as disclosed herein.

The present invention also relates to a vehicle comprising a frame having at least one transversal portion and at least one wheel for the movement on a track and at least one seat for one or more passengers. The vehicle further comprises an intermediate portion arranged between said frame and said at least one seat.

According to an aspect of the invention, the width of the intermediate portion is equal to, or less than, the width of the transversal portion of the vehicle, preferably equal to, or less than, 70% of the width of the transversal portion of the vehicle, more preferably equal to, or less than, 50% of the width of the transversal portion of the vehicle, most preferably equal to, or less than, 30% of the width of the transversal portion of the vehicle.

Advantageously, by doing so, the vehicle can be provided with a reduced floor. According to an aspect, the intermediate portion of the vehicle is arranged in an opening of a platform when the vehicle is in a station for the embarkation/disembarkation of the passengers.

Further aspects and features of the station according to the invention are disclosed herein.

The vehicle can be used in an amusement ride comprising a station provided with a platform and an opening, for example in an amusement ride according to the invention, as disclosed herein.

The present invention also relates to an amusement ride according to a further possible embodiment, comprising a track along which at least one vehicle is movable, and at least one station for the embarkation and/or disembarkation of passengers, said station comprising at least one platform arranged above a portion of said track in correspondence of the station, said platform comprising an opening for the transit of the at least one vehicle in said station, at least one floor element arranged in at least one first position in which said floor element closes said opening and movable from said at least one first position to at least one second position to allow the transit of said vehicle in said station, and viceversa, wherein said at least one floor element in said at least one first position is arranged to be contacted by said at least one vehicle to move said floor element from said at least one first position to said at least one second position.

An advantage of this embodiment is to provide a control of the movement of the floor element directly by the vehicle moved in said station.

Accordingly, the present invention also relates to a method of operating an amusement ride comprising the step of moving said at least one vehicle along said track and in a station comprising at least one platform for the embarkation and/or disembarkation of passengers, and the step of moving at least one floor element from at least one first position, in which said floor element closes an opening of the platform, to at least one second position allowing the transit of said vehicle in said station, wherein said at least one floor element is contacted by said at least one vehicle to move said floor element from said at least one first position to said at least one second position.

Accordingly, the present invention also relates to a station comprising at least one platform arranged above a portion of a track in correspondence of the station, and an opening for the transit of the at least one vehicle in said station, at least one floor element arranged in at least one first position in which said floor element closes said opening and movable from said at least one first position to at least one second position to allow the transit of said vehicle in said station, and viceversa, wherein the at least one floor element in said at least one first position is arranged to be contacted by said at least one vehicle to move said floor element from said at least one first position to said at least one second position.

It has to be noted that further features and aspects disclosed herein, and/or in the claims, in connection to another embodiment can be applied to this embodiment.

The present invention also relates to an amusement ride according to a further possible embodiment, comprising a track along which at least one vehicle is movable, and at least one station for the embarkation and/or disembarkation of passengers, said station comprising at least one platform arranged above a portion of said track in correspondence of the station, said platform comprising an opening for the transit of the at least one vehicle in said station, at least one floor element arranged in at least one first position in which said floor element closes said opening and movable from said at least one first position to at least one second position to allow the transit of said vehicle in said station, and viceversa, wherein said at least one floor element is movable (preferably rotatable), in a plane between said at least one first position and said at least one second position, said plane being substantially parallel to said platform.

An advantage of this embodiment is to reduce the space needed for the movement of the floor elements.

Accordingly, the present inventions also relates to a method of operating an amusement ride comprising the step of moving said at least one vehicle along said track and in a station comprising at least one platform for the embarkation and/or disembarkation of passengers, and the step of moving at least one floor element from at least one first position, in which said floor element closes an opening of the platform, to at least one second position to allow the transit of said vehicle in said station, wherein the at least one floor element is moved (preferably rotated) in a plane, between said at least one first position and said at least one second position, said plane being substantially parallel to said platform.

Accordingly, the present invention also relates to a station comprising at least one platform arranged above a portion of a track in correspondence of the station, and an opening for the transit of the at least one vehicle in said station, at least one floor element arranged in at least one first position in which said floor element closes said opening and movable from said at least one first position to at least one second position to allow the transit of said vehicle in said station, and viceversa, wherein said at least one floor element is movable, (preferably rotatable), in a plane, between said at least one first position and said at least one second position, said plane being substantially parallel to said platform.

It has to be noted that further features and aspects disclosed herein, and/or in the claims, in connection to another embodiment can be applied to this embodiment.

BRIEF DESCRIPTION OF THE DRAWINGS

Other features, advantages and details appear, by way of example only, in the following detailed description, the detailed description referring to the drawings, in which.

DETAILED DESCRIPTION OF THE PRESENT INVENTION

The amusement ride 1 according to the invention comprises a track 10 along which a vehicle 50 is movable and at least one station 2 where the vehicle 50 can transit for the embarkation and/or disembarkation of passengers. The vehicle 50 is arranged to travel on (above) the track 10.

The vehicle 50 can be stopped at said station in one or more stop position for the embarkation and/or disembarkation of passengers, or the vehicle can be moved in the station and the embarkation/disembarkation is carried out while the vehicle is moving.

In this case, the velocity of the vehicle in the station can be reduced to safely carry out the embarkation/disembarkation operations.

It has to be also noted that to carry out the embarkation/disembarkation while the vehicle 50 is moving in the station 2, transport means of the passengers (not shown) can be provided, such as for example at least one conveyor belt, or similar transport means, to move the passenger on said platform.

Preferably, the velocity of the transport means of the passengers is equal to, or less than, the velocity of the vehicle in said station during the embarkation/disembarkation of the passengers.

It has to be noted that in the attached figures, only a portion of the track 10 is shown in correspondence of the station 2 (see FIGS. 1 and 3), but it also extends outside the station and it can be shaped with rectilinear and/or curved portions.

The track 10 is preferably at least in part suspended from the ground to provide ascents/descents. In general, the track 10 can be designed to provide the desired movement of the vehicle during the ride, i.e. by providing turns, hills, etc.

Figure 4A:
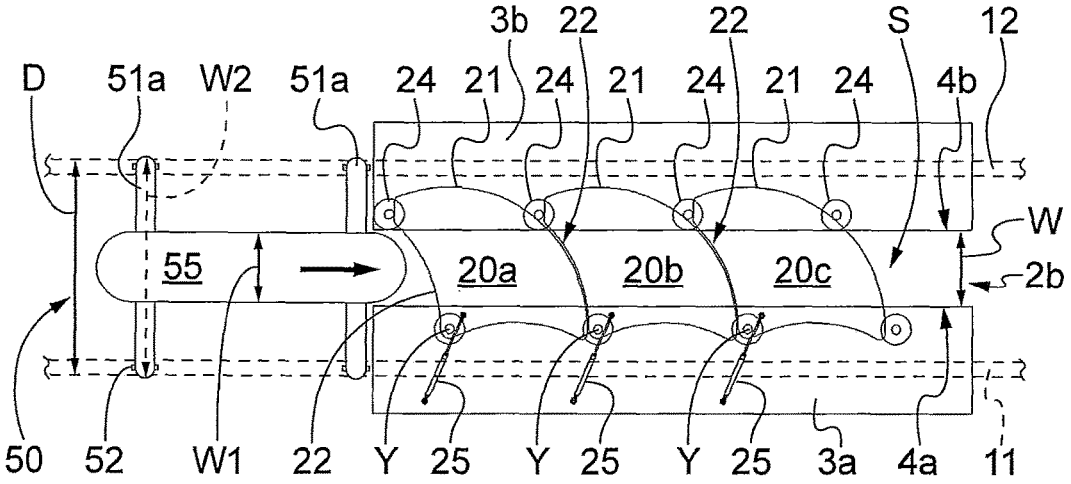
FIGS. 4A-4D show the movement of the at least one vehicle in the station for the embarkation/disembarkation of passenger(s) in an amusement ride according to the invention.
Figure 4B:
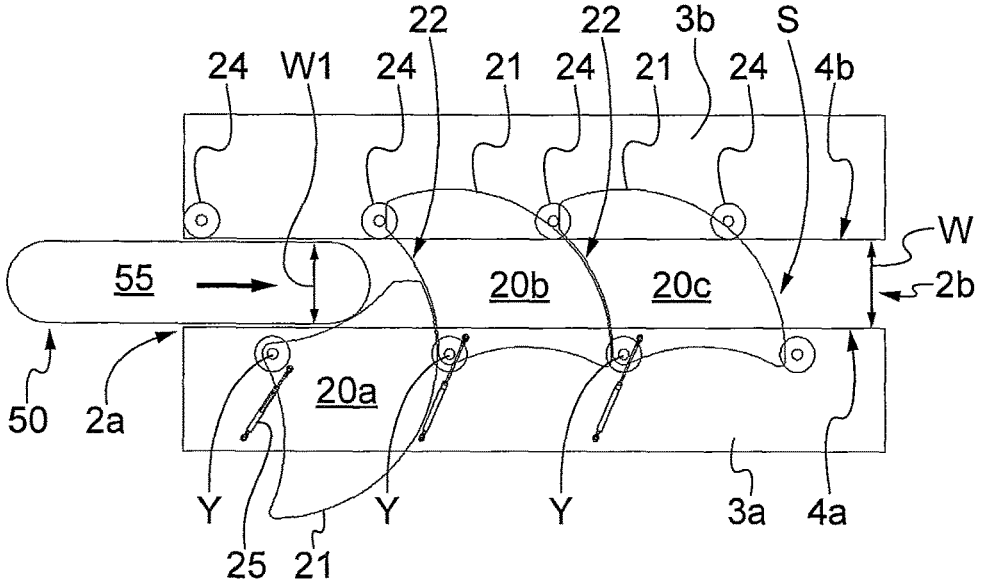
Figure 4C:
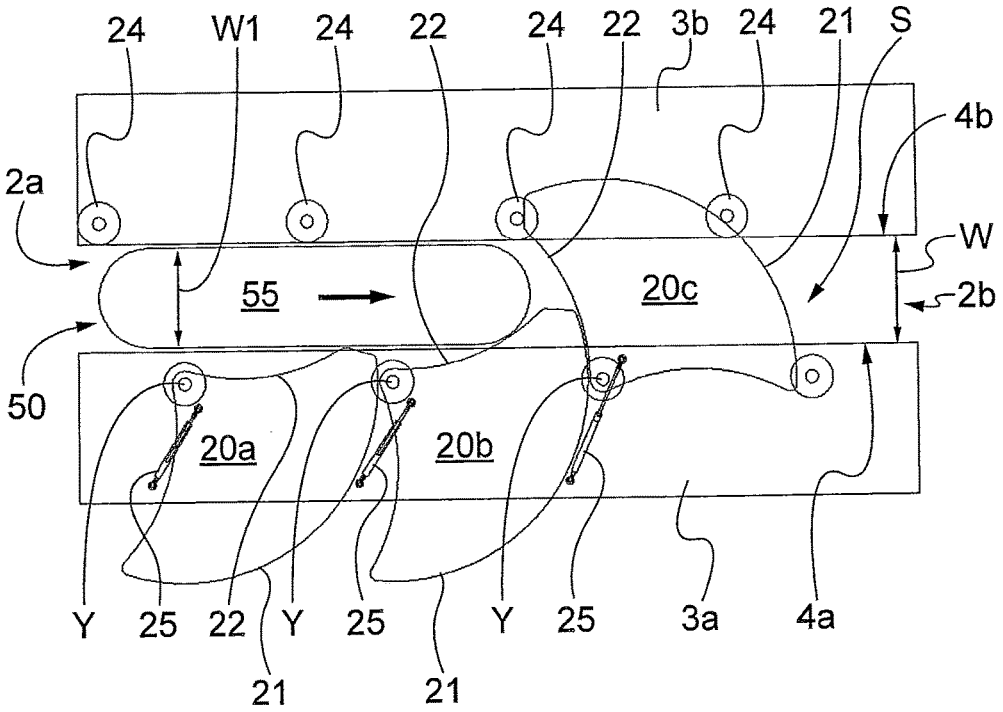
Figure 4D:
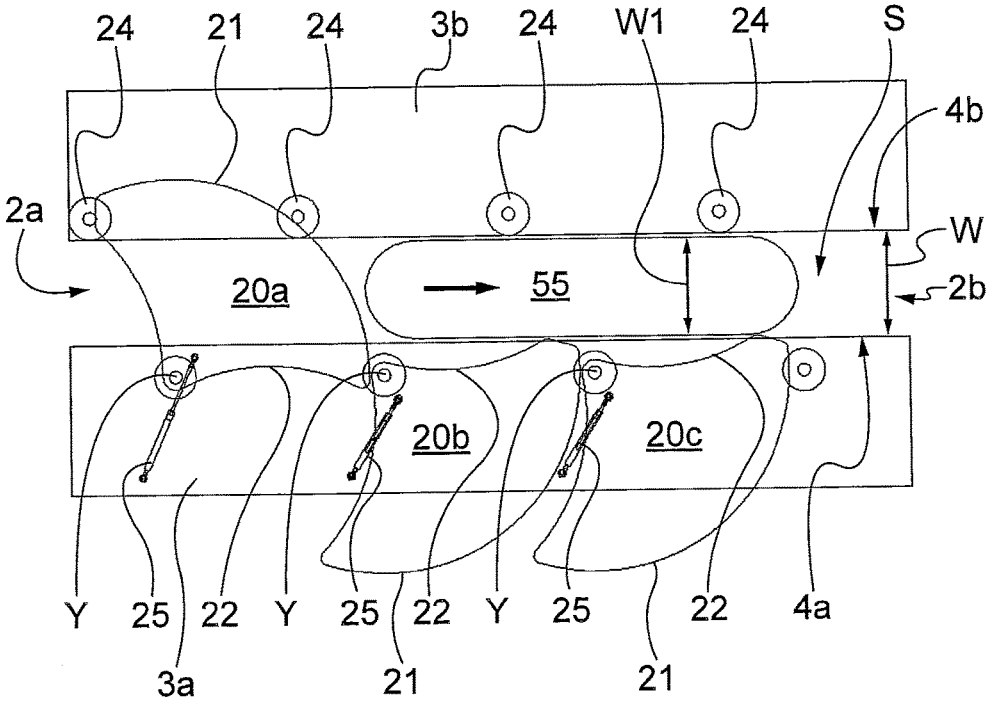

According to a preferred embodiment of the invention the track 10 is provided with a closed shape, i.e. the at least one vehicle 50 enters the station 2 from a first side 2*a* (as shown for example in FIG. 4A) and exits the station from a second side 2*b*, substantially opposite to the first side (see for example FIG. 4D).

It has to be noted that even if the tracks are schematically shown only in FIG. 4A, the same applies also to FIGS. 2, and 4B-4D where the track 10 is not shown.

Figure 1:
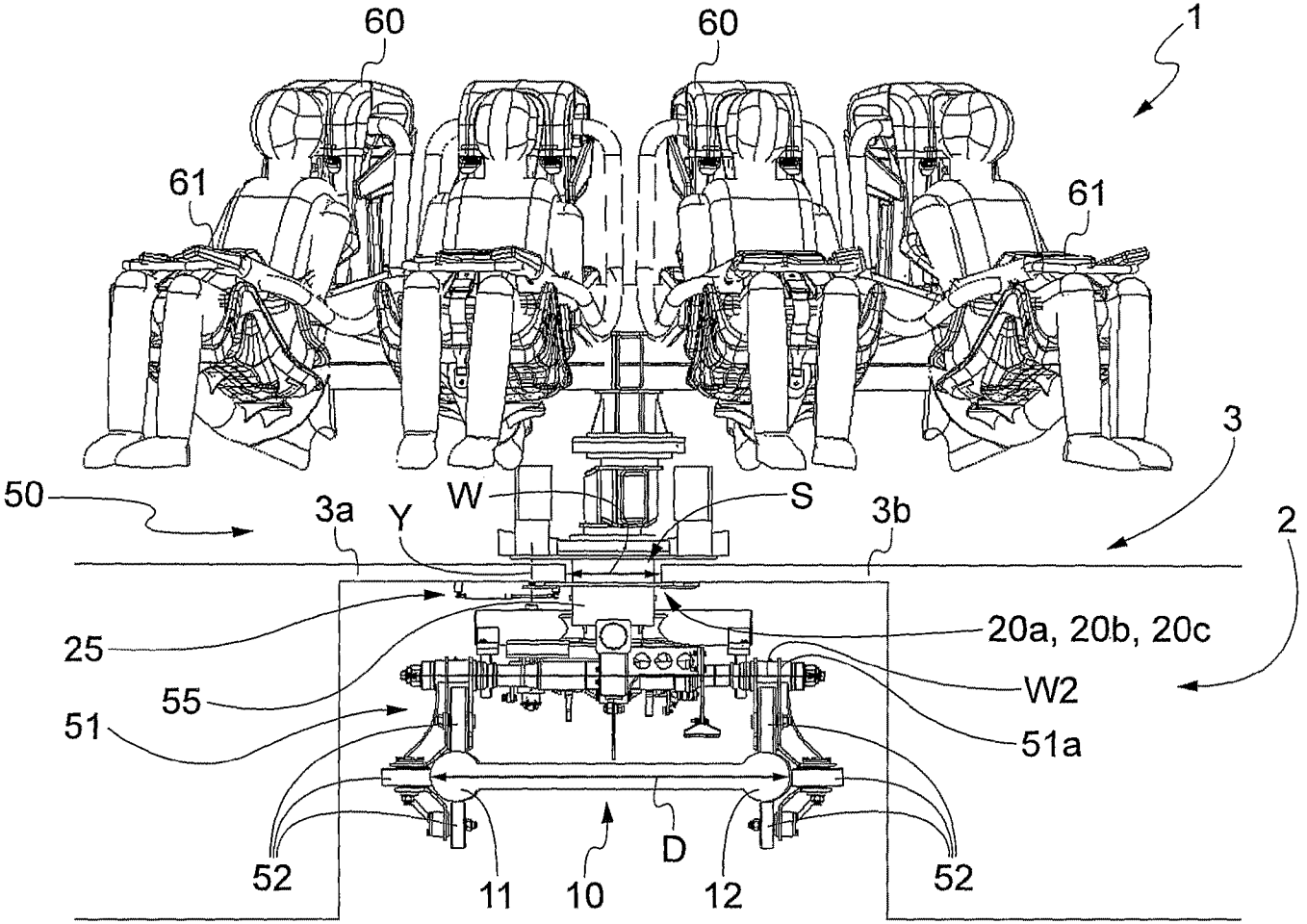
FIG. 1 is a frontal view of an amusement ride according to the invention wherein a vehicle is shown in correspondence of the station for the embarkation/disembarkation of passenger(s)
Figure 2:
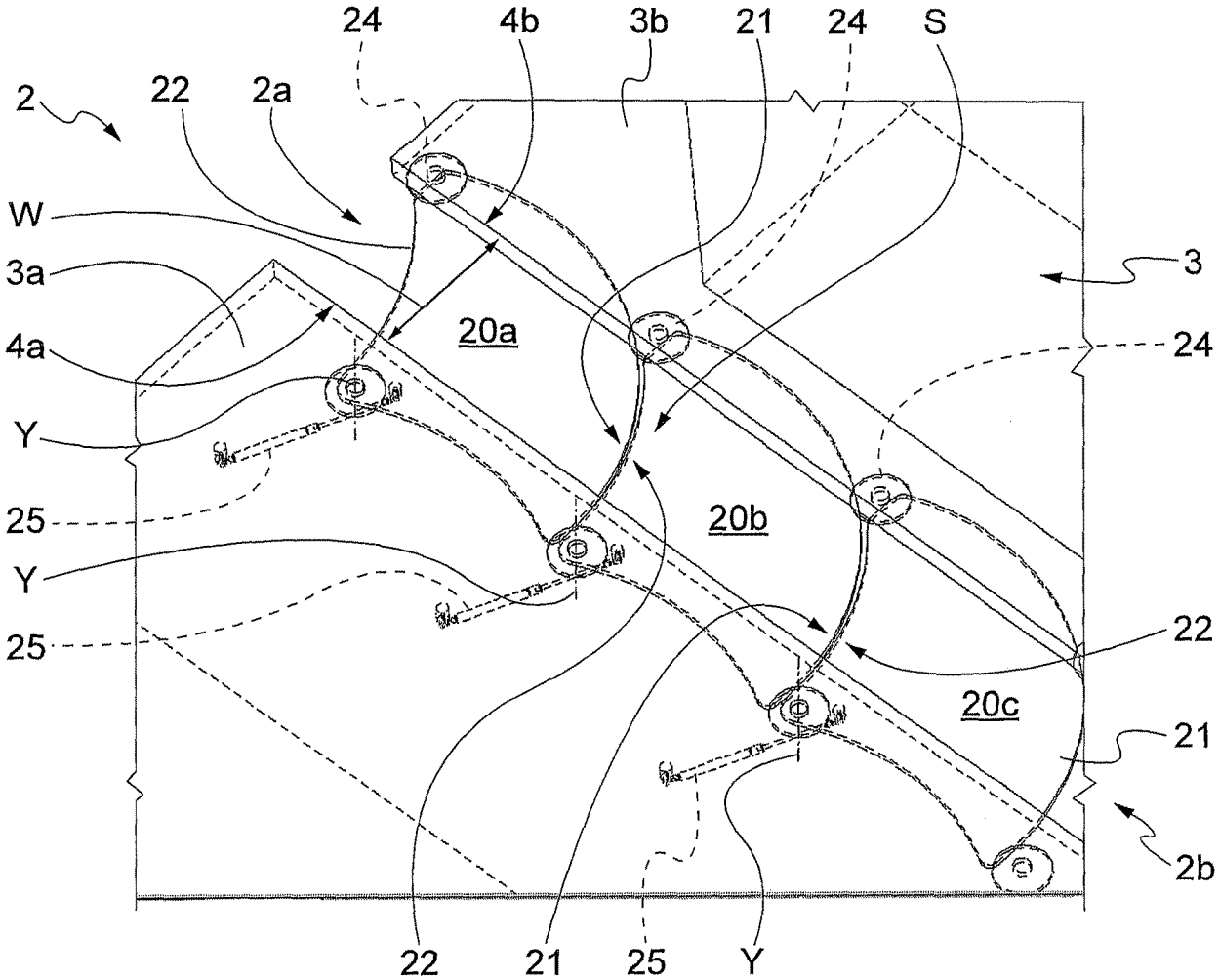
FIG. 2 is a perspective view of a station of an amusement ride according to the invention.
Figure 3:
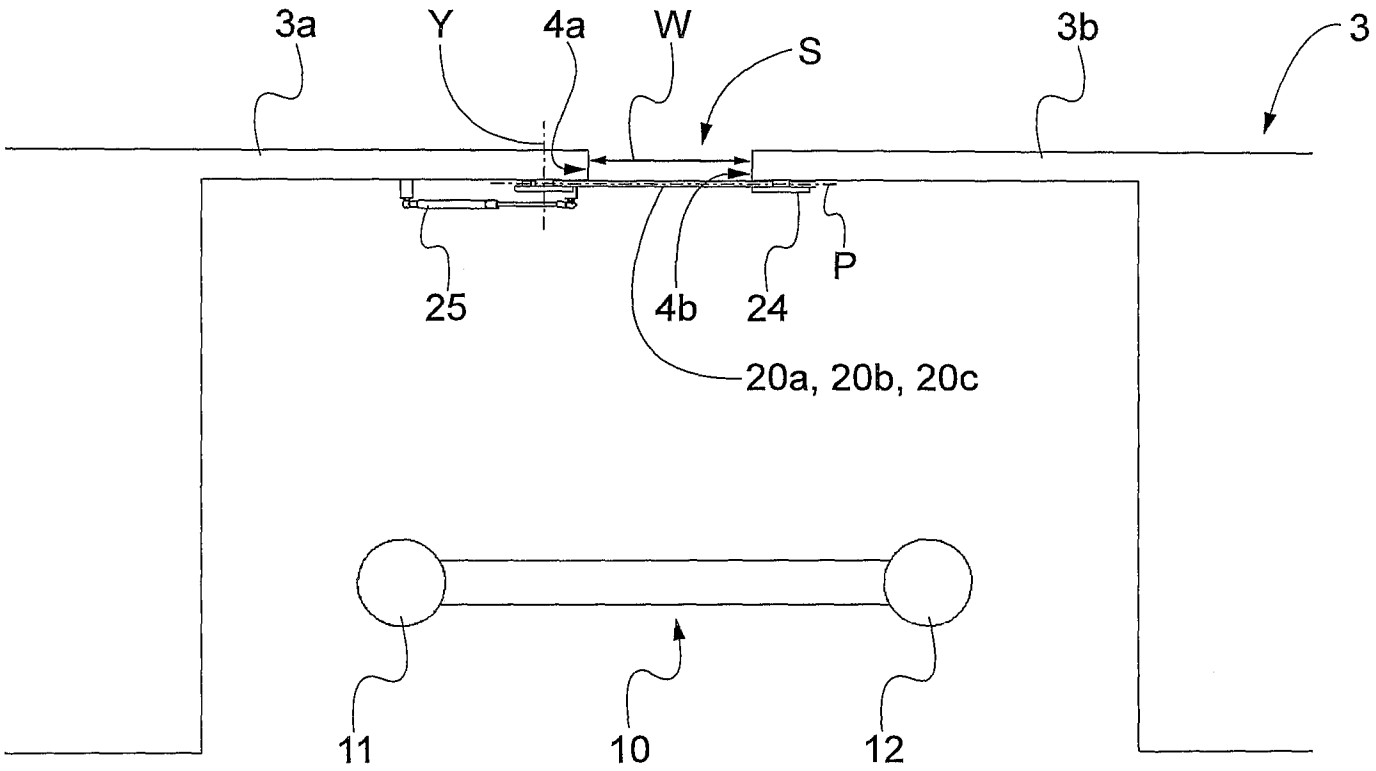
FIG. 3 is a frontal view according to FIG. 1, wherein the vehicle is not shown.

Moreover, it has to be noted that the vehicle 50 is shown in FIG. 1, schematically shown in FIGS. 4A-4D, and it is not shown in FIGS. 2, 3.

The track 10 can be provided in the form of a single rail, or with two or more rails which are preferably arranged parallel one to another (as for example in shown in the figures). Also a configuration with more than two rails can be provided.

According to a preferred embodiment, as for example shown in FIGS. 1 and 3, the track 10 comprises two rails 11, 12.

The station 2 comprises at least one platform 3 arranged above a portion of said track 10 passing in correspondence of the station 2.

The station 2 further comprises an opening S for the transit of the at least one vehicle 50 in the station 2. As mentioned above, the vehicle can be stopped in at least one stop position at the station for carrying out the embarkation/disembarkation of passengers, or these operations can be carried out while the vehicle is moving in said station.

The opening S is provided on said at least one platform 3.

According to an aspect of the invention the opening S is arranged so as to define two portions 3*a*, 3*b* of said at least one platform. Preferably, the opening S is delimited by two substantially opposite portions 3*a*, 3*b* of the platform 3. The portions 3*a*, 3*b* of the platform 3 comprises an edge 4*a*, 4*b*, delimiting the opening S.

In other words, said opening S is provided between two opposite portions 3*a*, 3*b* of said at least one platform 3, and in particular between two edges 4*a*, 4*b* of the platform 3.

According to a possible configuration, the opening S is extending between the first and second sides 2*a*, 2*b* of the station 2 so as to allow the entrance and the exit of the vehicle 50 in/from the station 2.

The opening S is preferably provided with an elongated shape according to the direction of extension of the track 10. The opening S is preferably extending parallel to the direction of extension of the track 10.

As already mentioned above, the track 10 comprises two rails 11, 12 and the width W of the opening S of the platform 3 is equal to, or less than, the distance D between two rails 11, 12 of the track 10.

According to possible embodiments, the width W of the opening S can be equal to, or less than, 70% of the distance D between the rails 11, 12 of the track, more preferably equal to, or less than, 50% of the distance D between the rails 11, 12 of the track, most preferably equal to, or less than, 30% of the distance D between the rails 11, 12 of the track.

According to an aspect of the invention, the opening S represent a small gap in the platform and the width W could be for example about 0.5 meter, or less.

It has to be noted that the width W of the opening S corresponds to a transversal dimension of the opening S, preferably taken between the opposite portions 3*a*, 3*b* (e.g. between two opposite edges 4*a*, 4*b*) of the platform 3. The distance D of the rails 11, 12 of the track 10 is preferably measured along a direction that is perpendicular to the two rails 11, 12. The width W can be measured along a direction coincident to, or parallel to, the direction along which the distance D between the rails 11, 12 is measured.

If the track comprises more than two rails, the distance D is measured between the two lateral rails of the track.

The station 2 of the amusement ride 1 according to the invention is provided with an area below the platform 3, where the track 10 is arranged, and an area above the platform 3 on which the passengers are supported during the embarkation/disembarkation. As it will be discussed later, a portion of the vehicle 50 is arranged below the platform 3 and a portion of the vehicle 50 comprising one or more seat 60 for the passenger, is arranged above the platform 3. According to an embodiment, an intermediate portion 55 is arrange between the portions of the vehicle that are located below and above the platform 3.

The reduced dimension of the opening S, and in particular of the transversal dimension of the opening (e.g. its width W) allows a reduced area that has to be covered for supporting the passengers during embarkation/disembarkation. As for example shown in FIG. 1, the vehicle 50 according to the invention comprises a frame 51 having at least one transversal portion 51*a* (e.g. transversal axle) and at least one wheel 52 for the movement on said track 10, and at least one seat 60 for accommodating one or more passengers.

The vehicle 50 is preferably provided with one or more seats 60 and restraining means 61 (such as belts and/or a restraint pad, and/or similar means) able to restraint the passenger during the ride. It has to be noted that two or more vehicle 50 can be provided to form of a train, i.e. comprising two or more vehicles that are constrained one to another.

The vehicle 50 is provided with wheels 52, or similar means, for moving the vehicle along the track 10. In other words, the vehicle is provided with one or more wheels 52 allowing the movement (sliding movement) of the vehicle 50 along the track 10. In the embodiment show in the figures a plurality of wheels 52 is arranged in correspondence of a lower frame 51 of the vehicle to contact a rail 11, 12 of the track 10.

The frame 51 comprises one or more transversal portion 51*a* (e.g. transversal axle) extending between the two or more rails 11, 12 of the track 10 so as to provide the contact of a wheel 52 with a rail. Preferably two transversal portions 51*a* (transversal axles) are provided to support the vehicle on the track (for example see FIG. 4A).

As for example shown in the figures, three wheels 52 are provided to contact each rail 11, 12 of the track 10.

The vehicle 50 further comprises an intermediate portion 55 arranged between the frame 51 and the at least one seat 60.

The intermediate portion 55 is intended to pass through the opening S when the vehicle is at said station 2, as for example shown in FIGS. 1, and 4A-4D. In other words, the intermediate portion 55 connects the portion of the vehicle arranged below the platform 3, i.e. the frame 51, to the upper part of the vehicle, arranged above the platform 3, where the at least one seat 60 intended to accommodate passengers is provided.

According to an aspect of the invention, the intermediate portion 55 is dimensioned so as to pass inside the opening S. In other words, the intermediate portion 55 is provided with a shape that is substantially complementary to the shape of the opening S. The cross section of the intermediate portion 55, preferably taken in a plane parallel or coincident to the platform, as for example shown in FIGS. 4A-4D, is shaped to have a width W1 substantially equal to (or less than, and preferably slightly less than) the width W of the opening S of the platform 3.

It has to be also noted that the width W1 of the intermediate portion 55 is substantially equal to, or less than, the width W2 of the transversal portion 51*a* of the vehicle 50, preferably equal to, or less than, 70% of the width W2 of the transversal portion 51*a* of the vehicle 50, more preferably equal to, or less than, 50% of the width W2 of the transversal portion 51*a* of the vehicle 50, most preferably equal to, or less than, 30% of the width W2 of the transversal portion 51*a* of the vehicle 50.

The width W2 of the transversal portion 51*a* (e.g. transversal axle) of the frame 51 substantially corresponds to the distance D between the rails of the track 10 on which the vehicle is movable. In fact, the transversal portion 51*a* of the vehicle 50 is intended to support the vehicle on the track and it is preferably extending substantially perpendicular to the rail of the track.

According to possible embodiments, the width W1 of the intermediate portion 55 can be equal to, or less than the distance D between the rails 11, 12 of the track 10. Preferably, the width W1 of the intermediate portion 55 is equal to, or less than 70% of the distance D between the rails 11, 12 of the track, more preferably equal to, or less than, 50% of the distance D between the rails 11, 12 of the track, most preferably equal to, or less than, 30% of the distance D between the rails 11, 12 of the track.

According to an aspect of the invention, the intermediate portion 55 is provided with an elongated shape, and its extension in length can be selected to support the one or more seats 60 on which the passengers are accommodated, and also to provide a connection with the frame 51, comprising one or more transversal portion (e.g. axle) adapted to support the vehicle on the track.

The at least one seat 60 of the vehicle can be fixed to the intermediate portion 55, or can be movable with respect to said intermediated portion 55.

In other words, the one or more seats 60 of the vehicle can be fixed directly or indirectly to the intermediate portion 55, and thus to the frame 51. Alternatively, the seat 60 can be movable with respect to the intermediate portion 55, so as to allow movement of the seat 60 with respect to the rest of the vehicle during the ride along the track 10.

The one or more seat 60 can be arranged rotatable with respect to an intermediate portion 55, about a pivot point. According to a possible configuration, the at least one seat 60 is connected to at least one arm, which can be fixed, or movable (e.g. rotatable), with respect to the intermediate portion 55 of the vehicle.

The presence of an intermediate portion 55 allows to reduce the overall dimension of the vehicle, and allows to eliminate, or at least to reduce, the floor of the vehicle for the embarkation/disembarkation of the passengers.

By doing so, the experience and fun for the passengers can be increased during the ride, in fact, the view is not obstructed by undesired floor portions of the vehicle.

At the same time, when the vehicle 50 is at the station 2, the passengers can be supported by the platform 3 by means of movable floor elements 20*a*, 20*b*, 20*c*.

In fact, the amusement ride 1 according to the invention, comprises at least one floor element 20*a*, 20*b*, 20*c* movable between at least one first position, in which the floor element closes said opening S, and at least one second position allowing the transit of the vehicle. It has to be noted that in the second position at least part of the opening is not occupied by the floor element 20*a*, 20*b*, 20*c*. The embodiment shown in the figures comprises three floor elements 20*a*, 20*b*, 20*c*, however the number of the floor elements can be varied according to different embodiments.

In the first position the floor element 20*a*, 20*b*, 20*c* is arranged to close, i.e. to occupy the opening S.

More in detail, in the first position the floor element is arranged to cover the opening S by extending between two portions 3*a*, 3*b* of the platform 3, defined by the opening S.

In the first position the floor element 20*a*, 2*b*, 20*c* is extending between the edges 4*a*, 4*b* of the portions 3*a*, 3*b* of the platform 3 (see for example the floor elements 20*a*, 20*b*, 20*c* in FIGS. 2 and 4A, floor elements 20*b*, 20*c* in FIG. 4B, floor element 20*c* in FIG. 4C, and floor element 2*a* in FIG. 4D).

In other words, in the first position, the floor element 20*a*, 20*b*, 20*c* forms a bridge between two opposite sides of the opening S, preferably corresponding to two opposite edges 4*a*, 4*b* of the platform 3.

In the second position the at least one floor element is substantially completely arranged outside the opening S, so as to allow the movement of the vehicle in the station (see for example the floor element 20*a* in FIG. 4C and the floor elements 20*b*, 20*c* in FIG. 4D which are in the second position).

When the floor element 20*a*, 20*b*, 20*c* is in the second position, the opening S is not closed, i.e. not occupied by the floor element, and the vehicle 50, and in particular its intermediate portion 55, can pass inside the opening S during the transit of the vehicle in the station 2.

According to an aspect of the invention, the at least one floor element 20*a*, 20*b*, 20*c* is movable in a plane P, see for example FIG. 3, between said at least one first position and said at least one second position.

The plane P is substantially parallel to the platform 3. According to a preferred configuration, as for example shown in the figures, the plane P is parallel to the platform 3.

Preferably, the at least one floor element 20*a*, 20*b*, 20*c* is rotatable in a plane P, see for example FIG. 3, between said at least one first position and said at least one second position. As mentioned above, the plane P is substantially parallel, or parallel, to the platform 3.

According to a possible embodiment, the at least one floor element 20*a*, 20*b*, 20*c* is rotatable about a rotation axis Y between said at least one first position and said at least one second position.

The rotation axis Y is substantially perpendicular to said platform 3. Preferably, the rotation axis is perpendicular to the platform 3. Therefore, the movement of the floor element is carried out in a plane that is substantially parallel to the plane defined by the platform 3.

More in detail the at least one floor element 20*a*, 20*b*, 20*c* is rotatably constrained in correspondence of a pivot point, or a pivot area.

The pivot point, or pivot area, and thus the rotation axis Y is preferably arranged in correspondence of the platform 3.

The rotation axis Y about which the floor element is rotatable is arranged at one of the portions 3*a* of the platform 3 defined by the opening S.

On the other portion 3*b* of the platform 3 defined by the opening S, at least one seat 24 is provided to support the floor element, so as to provide the required resistance to the weight of the passengers arranged on the floor portions in the first position.

In the first position, the floor element engages one or more seat 24 intended to offer a resistance to a downward force exerted by the weight of the passenger passing on the floor element during the embarkation/disembarkation.

The pivot point, or pivot area, of the floor element, and thus also the rotation axis Y, is arranged outside the opening S.

The floor element 20*a*, 20*b*, 20*c* can comprises a plate, i.e. it can be formed by a flat element, and the plane P in which the floor element is movable, and preferably rotatable, corresponds to, or is parallel to, the plane defined by the plate. The same applies to a floor element not shaped as a plate, but provided with at least one flat surface intended to support the passengers.

The plane P in which the floor element is movable, and preferably rotatable, corresponds to, or is parallel to, the plane defined by the at least one flat surface of the floor element.

The rotation axis Y is substantially perpendicular to the plane defined by the plate when the floor element 20*a*, 20*b*, 20*c* comprises a plate, i.e. when it is formed by a flat element. Again, the same applies to a floor element not shaped as a plate, but provided with at least one flat surface intended to support the passengers. The rotation axis Y is substantially perpendicular to the plane defined by the at least one flat surface of the floor element 20*a*, 20*b*, 20*c*.

It follows that the floor element comprising a plate, or having at least one flat surface can be moved in the plane defined by said plate, or by said at least one flat surface, that is preferably parallel to the platform 3.

In fact, the rotation axis Y is preferably arranged substantially perpendicular to both the platform 3 and to the plate forming the floor element 20*a*, 20*b*, 20*c*, or to the at least one flat surface of the floor element.

According to an aspect, the movement of the at least one floor portion 20*a*, 20*b*, 20*c* from the first position to the second position is caused by the contact of the floor element with the vehicle 50.

According to a possible embodiment, as for example shown in the figures, the arrangement of the rotation axis Y of the floor element outside the opening S allows the floor element to rotate about said axis Y towards the second position, due to the contact with the vehicle, and in particular with its intermediate portion 55.

It has to be noted that the floor elements 20*a*, 20*b*, 20*c* can be arranged below the platform 3, as for example shown in the figures, however different positions can be provided for example by providing the floor elements at least in part arranged inside the platform 3.

However, the floor element can be also arranged above the platform 3.

The at least one floor element 20*a*, 20*b*, 20*c*, in the first position, can be arranged to be contacted by the vehicle 50 to move the floor element 20*a*, 20*b*, 20*c* from said first position to at least one second position, wherein the opening S is not covered by the floor element and therefore the vehicle can be moved in said station 2.

The floor element 20*a*, 20*b*, 20*c* is a passive element, in fact, no actuators, or similar moving means are needed to control the movement of the floor element.

Preferably, the movement of the at least one floor element is controlled by the movement of the vehicle 50 passing in the station 2, and in particular by the contact of the vehicle 50 with the at least one floor element.

Returning means 25 can be provided to move the at least one floor element 20*a*, 20*b*, 20*c* from the at least one second position back to said at least one first position in which the floor element closes the opening S.

In other words, returning means 25 are provided to maintain (to bias) the at least one floor element 20*a*, 20*b*, 20*c* in the first position, in which the floor element closes the opening S.

The returning means 25 can comprise at least one spring, for example a gas spring, acting on said floor element to maintain it in the first position.

According to a possible aspect, as for example shown in figures, a gas spring 25 is provided for each floor element 20*a*, 20*b*, 20*c*, exerting on it a force pushing the floor element in the first position.

It has to be noted that other returning means 25 can be used, instead of a spring disclosed herein, for example at least one elastic element exerting a force on the floor element to maintain it in the first position.

Preferably, returning means 25 of the passive type are provided. As already discussed above, the term passive is used to indicate that no active control or command are needed to move the floor element connected to the returning means.

Returning means exert a force (a biasing force) to maintain the floor element in the first position and to allow the automatic return (without the need of an active command) from the second position back to the first position. The movement from the first position to the second position is preferably obtained by overcoming the biasing force exerted by the returning means intended to maintain the floor element in the first position.

More in detail, to move (and in particular to rotate) the floor element from the first position towards the at least one second position, it is necessary to exert a force (e.g. by the contact with the vehicle at the station) on the floor element that is greater than the force exerted by the returning means 25, and intended to maintain the floor element in the first position. When the floor element 20*a*, 20*b*, 20*c* is no longer contacted by the vehicle the force exerted by the returning means 25 (which is no longer overcome by the contact of the vehicle at the station with the floor element) is automatically moved from said at least one second position back to said first position.

As for example shown in the figures, see FIGS. 4A-4D, the contact of the vehicle 50, and in particular of the intermediate portion 55, with the floor element allows the latter to rotate from the first position in the second position. If two or more floor elements are provided, as for example in the aspect shown in the figures, the floor elements 20*a*, 20*b*, 20*c*, are complementary shaped one with respect to another. By doing so, a substantially continuous surface can be provided.

In other words, the platform 3 can be advantageously uniformly covered, without presenting discontinuities or openings between the floor elements 20*a*, 20*b*, 20*c*.

See for example FIG. 4A, wherein the floor elements 20*a*, 20*b* and 20*c* are all in the first position and the opening S can be advantageously covered in a continuous and uniform way.

According to an aspect, the at least one floor element 20*a*, 20*b*, 20*c* comprises at least one curved portion 21 so that the floor element can be advantageously moved, and in particularly rotated (for example about the rotation axis Y), without contacting other floor elements.

When two or more floor elements are provided, the curved portion 21 of one floor element is intended to cooperate with a curved portion 22 of another floor element.

In other words, in the first position the curved portion 21 of a first floor element is arranged in correspondence of a curved portion 22 of another floor element. According to a possible configuration, the floor element is provided with two curved portions 21, 22.

Advantageously, when two or more floor portions are provided, these floor elements 20*a*, 20*b*, 20*c* can be independently movable one with respect to another.

Thus, when a floor element is moved (e.g. rotated) between the first position and the second position the other floor elements are not moved, and are preferably maintained in the first position.

When the vehicle transit in said station 2, it contacts in succession the floor elements which are moved (e.g. rotated) independently one to another, so that only the contacted floor element is moved in the second position, while the other floor elements are maintained in the first position, thus covering the opening S that is not occupied by the vehicle and in particular by its intermediate portion 55.

By doing so, it is possible to effectively support the passengers.

The present invention also relates to a method of operating an amusement ride. A possible embodiment will be now disclosed, with non-limitative reference to FIGS. 4A-4D.

It has to be noted that features and aspect disclosed in connection to the amusement ride 1 can be applied to the method, and the features and aspect disclosed in connection to the method can be applied to the amusement ride 1. The at least one vehicle is moved along the track 10 and in a station 2 comprising at least one platform 3 for the embarkation and/or disembarkation of passengers. The vehicle can be stopped at said station 2 for the embarkation and/or disembarkation of passengers during the transit of the vehicle in the station 2.

The method comprises the step of moving at least one floor element 20*a*, 20*b*, 20*c* from at least one first position, in which the floor element closes the opening S of the platform, to at least one second position to allow the transit of said vehicle 50 in the station 2.

The method further comprises the step of moving the at least one floor element 20*a*, 20*b*, 20*c* from the at least one second position back to the at least one first position. This step is can be carried out by returning means 25.

Advantageously, the transit of the vehicle 50 in the station 2 is allowed, while at the same time providing the required support for the passengers by the floor element maintained in the first position by the returning means 25.

More in detail, the one or more floor elements 20*a*, 20*b*, 20*c* are arranged in the first position so as to close the opening of the platform and thus providing the required support for the passengers.

The floor element is temporarily moved in the at least one second position to allow the transit of the vehicle in said station and subsequently returned (moved back) in the first position, preferably by the returning means.

According to an aspect, the at least one floor element 20*a*, 20*b*, 20*c* is contacted by the vehicle 50 to move it from the at least one first position to said at least one second position.

The at least one floor element 20*a*, 20*b*, 20*c* is maintained in the first position in which said floor element closes said opening S by said returning means 25, and the at least one floor element 20*a*, 20*b*, 20*c* is moved from said at least one second position back to said first position when said floor element is no longer contacted by the vehicle.

As already mentioned above, the movement of the at least one floor element between said first position and said second position, can be carried out in a plane P, that preferably is substantially parallel to the platform 3.

The method comprises the step of moving the at least one floor element 20*a*, 20*b*, 20*c* in a plane P, between said at least one first position and said at least one second position. The plane P is preferably substantially parallel to the platform 3.

According to an aspect, as already mentioned above, the at least one floor element is rotated between said first position and said second position. The method comprises the step of rotating, about a rotation axis Y substantially perpendicular to said platform 3, at least one floor element 20*a*, 20*b*, 20*c* from at least one first position in which said floor element closes the opening S of the platform to at least one second position for allowing the transit of the vehicle in the station 2.

FIGS. 4A-4D show the successive positions of the vehicle 50 (of which only the cross section of the intermediate portion 55 is shown) in the station 2.

Preferably, the first side 2*a* of the station 2 provide the entrance for the vehicle 50, while the second side 2*b* of the station 2 provides the exit for the vehicle 50. As shown, the intermediate portion 55 of the vehicle is passing in the opening S.

The opening S is covered by the floor elements 20*a*, 20*b*, 20*c* which are arranged in the first position (see FIG. 4A), in which they covers the opening S.

The floor elements 20*a*, 20*b*, 20*c* are maintained in the first position by the returning means 25, and in particular by the gas spring acting on them, preferably on each floor element.

The vehicle 50 advances in the station 2 by the movement on the track 10 arranged below the platform 3.

The first floor element 20*a* is contacted by the vehicle 50, and in particular by the intermediate portion 55 passing inside the opening S.

By doing so, the first element 20*a* is moved (e.g. by a rotation movement about the rotation axis Y), as for example shown in FIG. 4B, while the other floor elements 20*b*, 20*c* are maintained in the first position.

In the second position, the floor element is not covering the opening S, thus allowing the passage of the vehicle 50, and in particular of its intermediate portion 55.

While the vehicle 50 advances in the station S, the other floor elements 20*b* and 20*c* are contacted by the vehicle 50, and in particular by its intermediate portion 55, and moved towards the second position.

See for example FIG. 4C wherein the second floor element 20*b* is contacted by the vehicle 50 and moved (e.g. rotated) towards the second position (reached in FIG. 4D).

When the vehicle 50 does not contact a floor element, see for example floor element 20*a* in FIG. 4D that is no longer contacted by the vehicle, the floor element 20*a* returns (is moved back) in the first position due to the action of the returning means 25 exerting a force maintaining the floor element in the first position, thus causing a movement (e.g. rotation about the rotation axis Y), from the second position towards the first position.

During the movement of the vehicle in the station 2 it may be stopped in at least one stop position where the embarkation and/or disembarkation of the passengers is carried out.

As already mentioned above, according to a possible embodiment, the vehicle can be not stopped in said station 2 and the embarkation/disembarkation operations are carried out while the vehicle is moving in said station 2.

When the vehicle passes in the station 2, the floor elements not contacted by the vehicle 50, and in particular by its intermediate portions 55, are maintained in the first position so as to close the opening S and to provide required support for the passengers (see for example floor element 20*c* in FIG. 4C, or floor element 20*a* in FIG. 4D).

The floor elements contacted by the vehicle 50, and in particular by its intermediate portion 55, are arranged in the second position because the area of the opening S in correspondence of these floor elements is occupied by the vehicle 50, and in particular by its intermediate portion 55.

Therefore, the opening S of the platform 3 is advantageously closed by the floor elements in the first position and by the intermediate portion 55 of the vehicle 50, so that the passengers can be embarked/disembarked in safety conditions without the risk of falling in the opening S of the platform 3.

The invention claimed is:

1. Amusement ride comprising a track along which at least one vehicle is movable, and at least one station for the embarkation and/or disembarkation of passengers, said station comprising at least one platform arranged above a portion of said track in correspondence of the station, said platform comprising an opening for the transit of the at least one vehicle in said station, at least one floor element arranged in at least one first position in which said floor element closes said opening and movable from said at least one first position to at least one second position to allow the transit of said vehicle in said station, further comprising returning means configured to move said at least one floor element from said at least one second position back to said at least one first position in which said floor element closes said opening.

2. The amusement ride according to claim 1, wherein said at least one floor element in said at least one first position is arranged to be contacted by said at least one vehicle to move said floor element from said at least one first position to said at least one second position, preferably said at least one floor element being moved from said at least one second position back to said first position when said floor element is no longer contacted by said vehicle.

3. The amusement ride according to claim 1, wherein said returning means maintain the at least one floor element in the first position, in which the floor element closes the opening.

4. The amusement ride according to claim 1, wherein said at least one floor element is movable in a plane between said at least one first position and said at least one second position, said plane being substantially parallel to said platform.

5. The amusement ride according to claim 1, wherein said at least one floor element is rotatable about a rotation axis between said at least one first position and said at least one second position, said rotation axis being substantially perpendicular to said platform.

6. The amusement ride according to claim 1, wherein said returning means comprise at least one spring.

7. The amusement ride according to claim 1, wherein said opening defines two portions of said platform, the at least one floor element in said first position extending between said two portions of the platform.

8. The amusement ride according to claim 1, wherein said at least one floor element comprises at least one curved portion.

9. The amusement ride according to claim 1, wherein said plurality of floor elements are complementary shaped one with respect to another.

10. The amusement ride according to claim 1, wherein said plurality of floor elements are independently movable one with respect to another.

11. The amusement ride according to claim 1, wherein the track comprises at least two rails and the width of said opening of the platform is equal to, or less than, the distance between two rails of the track.

12. The amusement ride according to claim 1, wherein said vehicle comprises a frame having at least one transversal portion and at least one wheel for the movement on said track, said vehicle further comprising at least one seat for one or more passengers and an intermediate portion arranged between said frame and said at least one seat, wherein said intermediate portion is arranged in said opening when the vehicle is in said station.

13. Method of operating an amusement ride according to claim 1, comprising the step of moving said at least one vehicle along said track and in a station comprising at least one platform for the embarkation and/or disembarkation of passengers, and the step of moving at least one floor element from at least one first position, in which said floor element closes an opening of the platform, to at least one second position to allow the transit of said vehicle in said station, the method further comprising the step of moving the at least one floor element from said at least one second position back to said at least one first position by returning means.

14. The method according to claim 13, wherein said at least one floor element is contacted by said at least one vehicle to move said floor element from said at least one first position to said at least one second position, preferably the at least one floor element being moved from said at least one second position back to said first position when said floor element is no longer contacted by said vehicle.

15. The method according to claim 13, wherein said at least one floor element is moved in a plane between said at least one first position and said at least one second position, said plane being substantially parallel to said platform.

16. The method according to claim 13, wherein said at least one floor element is rotated about a rotation axis between said at least one first position and said at least one second position, said rotation axis being substantially perpendicular to said platform.

17. A station for an amusement ride, the amusement ride comprising a track and at least one vehicle movable along said track, the station comprising at least one platform arranged above a portion of said track, and an opening for the transit of the at least one vehicle in said station, at least one floor element arranged in at least one first position in which said floor element closes said opening and movable from said at least one first position to at least one second position to allow the transit of said vehicle in said station, further comprising returning means configured to move said at least one floor element from said at least one second position back to said at least one first position in which said floor element closes said opening.

* * * * *